US009924812B1

(12) United States Patent
Kennedy

(10) Patent No.: US 9,924,812 B1
(45) Date of Patent: Mar. 27, 2018

(54) INFANT SAFETY MATTRESS PAD

(71) Applicant: Chandrawatti Kennedy, Jamaica, NY (US)

(72) Inventor: Chandrawatti Kennedy, Jamaica, NY (US)

( * ) Notice: Subject to any disclaimer, the term of this patent is extended or adjusted under 35 U.S.C. 154(b) by 560 days.

(21) Appl. No.: 14/492,511

(22) Filed: Sep. 22, 2014

Related U.S. Application Data

(63) Continuation-in-part of application No. 13/860,059, filed on Apr. 10, 2013, now abandoned.

(51) Int. Cl.

| | |
|---|---|
| ***A47G 9/00*** | (2006.01) |
| ***A47G 9/02*** | (2006.01) |
| ***A47G 9/10*** | (2006.01) |
| ***A47C 27/00*** | (2006.01) |

(52) U.S. Cl.
CPC ..... *A47G 9/0253* (2013.01); *A47C 27/007* (2013.01); *A47G 9/0238* (2013.01); *A47G 9/0292* (2013.01); *A47G 9/10* (2013.01)

(58) Field of Classification Search
CPC ..... A47G 9/10; A47G 9/0253; A47G 9/0238; A47C 27/007
USPC ... 5/482, 485, 486, 489, 490, 495, 496, 498, 5/499
See application file for complete search history.

(56) References Cited

U.S. PATENT DOCUMENTS

| | | | | |
|---|---|---|---|---|
| 2,692,396 | A | 10/1954 | Cheesman | |
| 3,638,251 | A | 2/1972 | Weiss | |
| 4,014,055 | A | 3/1977 | Torres | |
| 5,438,719 | A | 8/1995 | Anthony | |
| 5,587,219 | A | 12/1996 | Schofield | |
| 5,587,300 | A | 12/1996 | Malter | |
| 5,638,562 | A * | 6/1997 | Masoncup | A47G 9/0246 5/482 |
| 5,887,300 | A * | 3/1999 | Pond | A47G 9/02 5/420 |
| 5,996,147 | A | 12/1999 | Trimble | |
| 6,044,503 | A * | 4/2000 | McClendon | A47G 9/02 5/482 |
| 6,049,925 | A | 4/2000 | Lewis | |
| 6,286,163 | B1 | 9/2001 | Trimble | |
| 6,370,717 | B1 * | 4/2002 | Kao | A47C 27/001 5/691 |
| 6,453,492 | B1 | 9/2002 | Sturrock | |
| 6,539,565 | B1 | 4/2003 | Trimble | |
| 6,658,676 | B1 | 12/2003 | Persson et al. | |
| 6,952,845 | B1 | 10/2005 | Akkad | |
| 7,516,500 | B2 | 4/2009 | Akkad | |
| 8,122,541 | B1 | 2/2012 | Georgatos | |
| 8,214,949 | B2 | 7/2012 | Thompson | |
| 8,307,476 | B1 | 11/2012 | Weaver et al. | |
| 2001/0032357 | A1 | 10/2001 | Fuentes et al. | |

(Continued)

*Primary Examiner* — David E Sosnowski
(74) *Attorney, Agent, or Firm* — Goldstein Law Offices, P.C.

(57) ABSTRACT

An infant safety mattress pad, for providing comfort and safety to an infant, using a mattress pad having a mattress pad body and a skirt, for use upon a bare mattress. The mattress pad body contains a padded absorbent layer, and has a pillow pocket, which contains a pillow. The bare mattress is covered with the mattress pad, and the mattress pad is fully covered by a standard bed sheet. Access to the pillow and its potential hazards are prevented by the full covering with the bed sheet.

2 Claims, 5 Drawing Sheets

(56) References Cited

U.S. PATENT DOCUMENTS

| | | | | |
|---|---|---|---|---|
| 2002/0088054 | A1* | 7/2002 | McCain | A47C 31/105 5/500 |
| 2002/0095726 | A1 | 7/2002 | Michetti | |
| 2003/0061659 | A1 | 4/2003 | Dunlap et al. | |
| 2005/0262634 | A1 | 12/2005 | Gottlieb | |
| 2005/0283910 | A1 | 12/2005 | DuQue | |
| 2007/0000053 | A1* | 1/2007 | Yang | A47G 9/02 5/493 |
| 2007/0283497 | A1* | 12/2007 | McCain | A47C 27/005 5/691 |
| 2008/0005845 | A1* | 1/2008 | Moran Pfleger | A47C 27/005 5/691 |
| 2008/0178386 | A1 | 7/2008 | Thompson | |
| 2009/0077746 | A1 | 3/2009 | Wilson | |
| 2010/0058537 | A1 | 3/2010 | Schuck | |
| 2010/0139002 | A1 | 6/2010 | Walker et al. | |
| 2010/0154125 | A1* | 6/2010 | Fratovich | A47C 21/022 5/691 |
| 2010/0242172 | A1* | 9/2010 | Lijesen | A47G 9/0246 5/413 R |
| 2012/0073049 | A1 | 3/2012 | Walker et al. | |
| 2012/0204348 | A1* | 8/2012 | Bayer | A47G 9/02 5/413 R |
| 2014/0109315 | A1* | 4/2014 | Lilienthal | A47C 31/105 5/497 |

* cited by examiner

INFANT SAFETY MATTRESS PAD

CROSS-REFERENCE TO RELATED APPLICATIONS

The present application claims priority to U.S. Provisional Patent Application Ser. No. 61/745,940, filed on Dec. 26, 2012, and U.S. patent application Ser. No. 13/860,059, filed on Apr. 10, 2013, which are herein incorporated by reference in its entirety for all purposes.

TECHNICAL FIELD

Generally, the present disclosure relates to infant bedding. More particularly, the present disclosure relates to a mattress pad which allows a child to sleep comfortably while avoiding the danger of suffocation normally associated with certain bedding materials and items.

BACKGROUND

All parents want their children to sleep comfortably. Through the ages, parents have provided their children with comfortable bedding, pillows, and plush toys in an attempt to make their children more comfortable. In recent decades, however, the danger of such practices has become apparent. It has been discovered that soft toys and pillows create a grave hazard of suffocation, and parents are warned not to use them. In fact, parents are often told not to put anything in the crib with the infant.

Certain medical conditions, however, make it desirable to elevate the head or torso of the infant. For example, many infants have a condition where their immature gastrointestinal system allows stomach acid to back up into their esophagus, causing them severe pain. Little can be done to ease these suffering infants, other than to have a parent hold them in an elevated position as they sleep. This solution is not sustainable, and certainly doesn't help the already sleep deprived parents get any rest! The alternative—placing a pillow loosely in the crib—is not advisable because of the dangers previously described.

Some solutions have been proposed, purportedly for safely using a pillow within a crib. The safety of these solution is debatable, however, as they typically still provide access to the pillow or allow the pillow to be dislodged such that it may become an instant hazard to the infant.

While certain aspects of conventional technologies have been discussed to facilitate the present disclosure, no technical aspects are disclaimed. The claims may encompass one and/or more of the conventional technical aspects discussed herein.

BRIEF SUMMARY

According to an example embodiment of the present disclosure an infant mattress pad is provided. The mattress pad includes a mattress pad body having a bottom surface that extends over a mattress, and has a skirt that extends over edges of the mattress to secure thereto. The mattress pad body has a head area and a foot area. The head area of the pad includes a pillow pocket, which contains a pillow.

According to another example embodiment of the present disclosure an infant is prevented from being harmed by the pillow. Accordingly, the mattress pad is fully covered by a sheet prior to placing the infant thereupon, preventing inadvertent access to the pillow and eliminating the possibility of danger therefrom.

The present disclosure provides an infant safety mattress pad, for providing comfort and safety to an infant, using a mattress pad having a mattress pad body and a skirt, for use upon a bare mattress. The mattress pad body contains a padded absorbent layer, and has a pillow pocket, which contains a pillow. The bare mattress is covered with the mattress pad, and the mattress pad is fully covered by a standard bed sheet. Access to the pillow and its potential hazards are prevented by the full covering with the bed sheet.

The present disclosure may be embodied in the form illustrated in the accompanying drawings. Attention is called to the fact, however, that the drawings are illustrative. Variations are contemplated as being part of the disclosure, limited only by the scope of the claims.

BRIEF DESCRIPTION OF THE DRAWINGS

The accompanying drawings, which are incorporated into and form a part of the specification, illustrate example embodiments of the present disclosure. Together with the detailed description, the drawings serve to explain the principles of the present disclosure. The drawings are only for the purpose of illustrating example embodiments of the present disclosure and are not to be construed as necessarily limiting the disclosure. Like numbers can refer to like elements throughout.

DETAILED DESCRIPTION OF THE PREFERRED EMBODIMENTS

Figure 1:
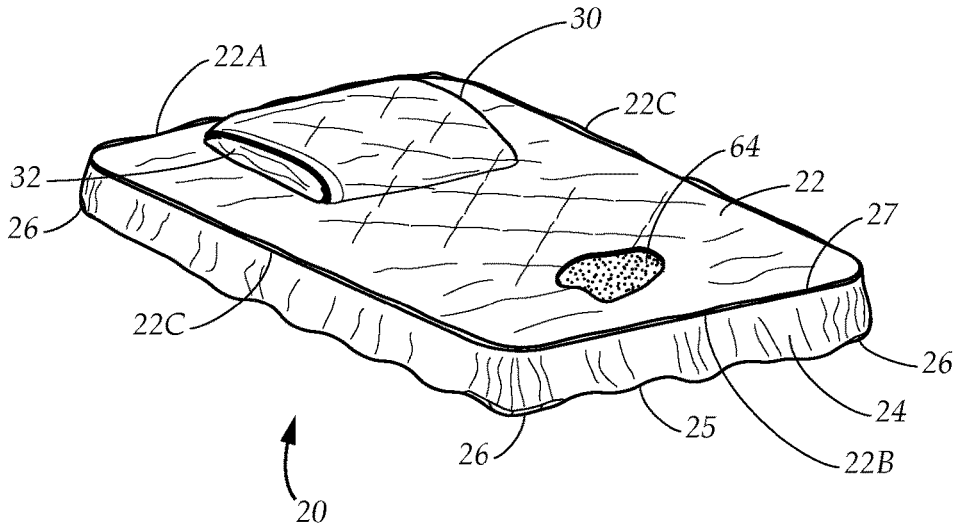
FIG. 1 shows a perspective view of an example embodiment of a mattress pad having a pillow pocket according to the present disclosure.

The present disclosure will now be described more fully with reference to the accompanying drawings, in which example embodiments of the disclosure are shown. The disclosure may, however, be embodied in many different forms and should not be construed as being limited to the embodiments set forth herein. Rather, these embodiments are provided so that this disclosure will be thorough and complete, and will fully convey the concept of the disclosure to those skilled in the art. Also, features described with respect to certain embodiments may be combined in various other embodiments. Different aspects and elements of the embodiments may be combined in a similar manner.

Any verbs as used herein can imply direct or indirect, full or partial, action or inaction. For example, when an element is referred to as being "on," "connected" or "coupled" to another element, then the element can be directly connected or coupled to the other element or intervening elements may be present. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing. Any and/or all elements can be formed from a same, structurally continuous piece and/or be separately fabricated and/or connected.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and will not be interpreted in an idealized or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of the device in addition to the orientation depicted in the accompanying drawings. For example, if the device in the accompanying drawings is turned over, elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

If any disclosures are incorporated herein by reference and such incorporated disclosures conflict in part or whole with the present disclosure, then to the extent of conflict, and/or broader disclosure, and/or broader definition of terms, the present disclosure controls. If such incorporated disclosures conflict in part or whole with one another, then to the extent of conflict, the later-dated disclosure controls.

FIG. 1 illustrates a mattress pad 20. The mattress pad 20 includes a mattress pad body 22, and a skirt 24.

Figure 4:
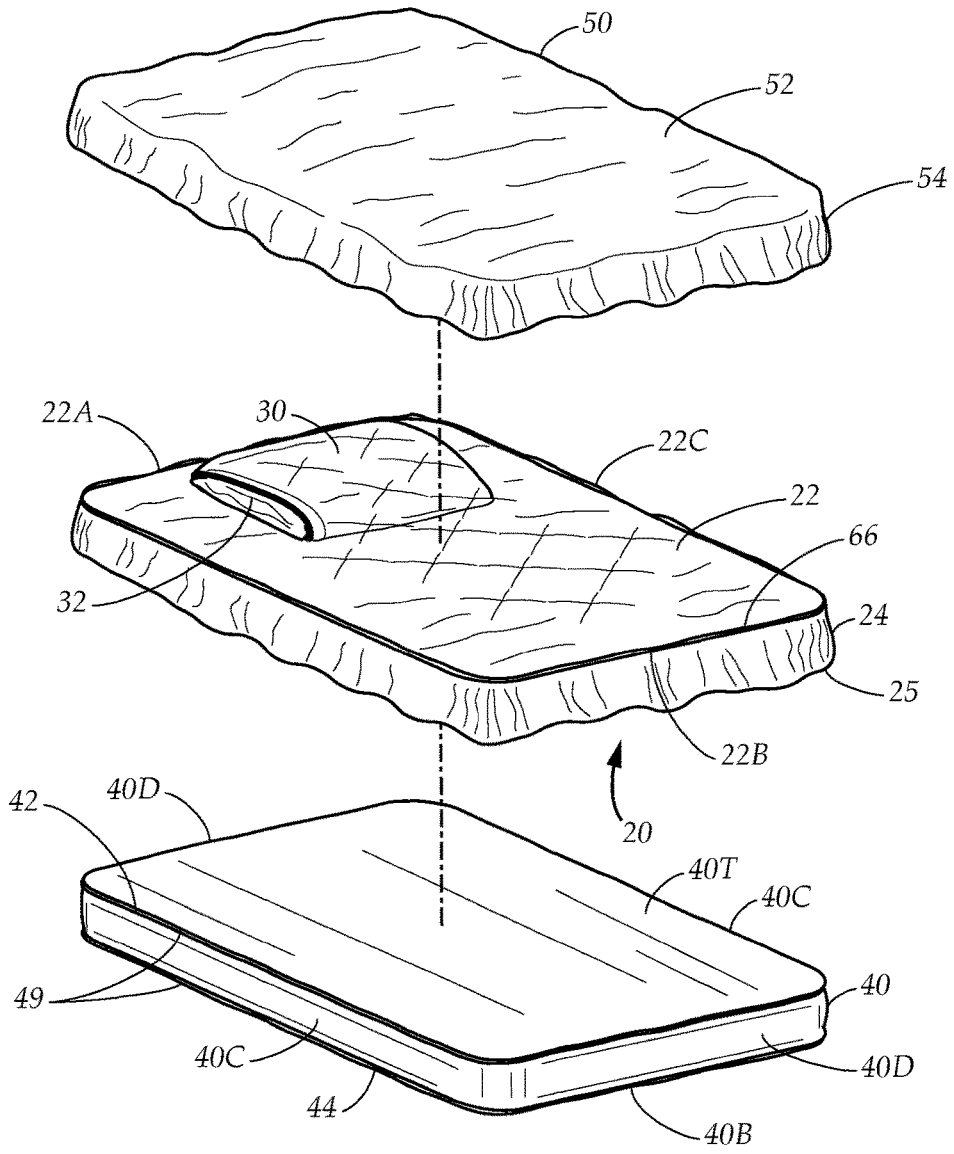
FIG. 4 shows a perspective view of an example embodiment of a bedding arrangement incorporating the mattress pad according to the present disclosure.

Referring to FIG. 4, the mattress pad 20 is configured for use on a bare mattress 40, which has a top surface 40T, a bottom surface 40B, longitudinal sides 40C and lateral sides 40D. The mattress has a top edge 42, which extends around the top surface 40 where it meets the longitudinal sides 40C and lateral sides 40D. The mattress also has a bottom edge 44, which extends around the bottom surface 40B where it meets the longitudinal sides 40C and lateral sides 40D. The mattress 40 has piping 49 extending coextensive with the top edge 42 and also coextensive with the bottom edge 44. The mattress pad 20 is designed to be covered by a bed sheet 50. The bed sheet having a sheet body 52, and a sheet hem 54.

Referring again to FIG. 1, the skirt 24 has a lower edge 25 and four lower corners 26 on the lower edge 25. The lower corners are preferably gathered, with elastic, rubber or the like, to effectively expand and contract the lower edge 25 to provide a secure and effective fit on the mattress. The mattress pad body 22 has a head portion 22A, and a foot portion 22B, on opposite ends thereof, and has a pair of longitudinal sides 22C. The skirt 24 also has an upper edge 27, where the skirt 27 adjoins the mattress pad body 22 along the head portion 22A, foot portion 22B, and longitudinal sides 22C.

In accordance with principles of the present disclosure, FIG. 1 also illustrates the mattress pad 20 having a pillow pocket 30, containing a pillow 32. The pillow pocket 30 and its associated pillow are located near the head portion 22A of the mattress pad body 22. Note that the pillow 32 is fully encased and concealed within the pillow pocket 30, such that a user cannot access edges of the pillow 32, but merely experiences a comfortable thickening of the mattress pad body 22 in the vicinity of the pillow 32.

Figure 3:
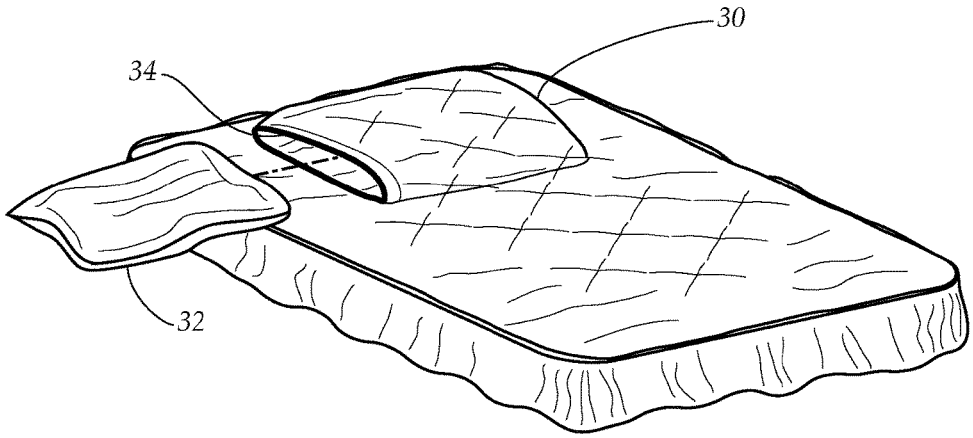
FIG. 3 shows a perspective view of an example embodiment of a pillow removable from a pillow pocket of a mattress pad according to the present disclosure.

Referring to FIG. 1 and FIG. 3, a pillow access opening 34 may be provided in the mattress pad 20 to allow the pillow 32 to be removed, cleaned and/or replaced as desired. The pillow access opening 34 is preferably a side opening to the pillow pocket 30, wherein it extends substantially parallel to the longitudinal sides 22C of the mattress pad body 22. The pillow access opening 34 may be made to selectively close, using hook and loop fasteners, zippers, snaps, or the like.

Figure 2:
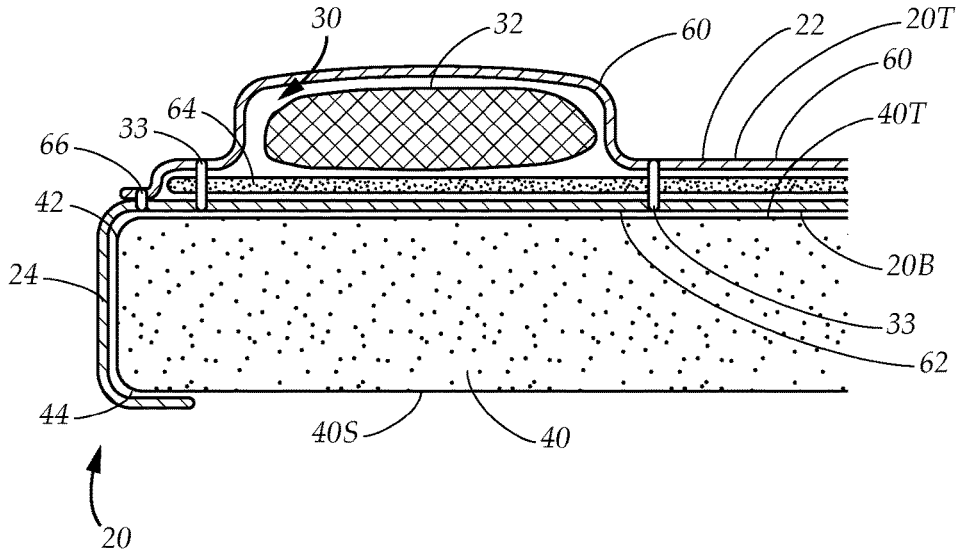
FIG. 2 is a side elevational view, with parts broken away, illustrating multiply construction of the mattress pad, and further internal details thereof.

Referring now to FIG. 2, the mattress pad 20 has a top 20T, and a bottom 20B. When made using conventional textiles, the mattress pad would typically include a top ply 60 and a bottom ply 62. The top ply 60 substantially defines the top 20T of the mattress pad 20, and the bottom ply 20B substantially defines the bottom 20B of the mattress pad 20. The top ply 60 and bottom ply 62 are generally constructed of single piece, substantially continuous sheets of a fabric textile, such as such as cotton, linen, wool, silk, bamboo fibre, flannel, silver, satin, rayon.

To provide the desired absorbent properties, a padded absorbent layer 64 is located between the top ply 60 and bottom ply 62, throughout the body 22. The padded absorbent layer 64 is a liquid absorbent material that absorbs spills and body fluids incident upon the mattress pad 20 and thereby help prevents such from reaching the mattress 40. Accordingly, during use of the mattress pad 20, it is desirable to have the padded absorbent layer 64 extend fully over the top 40T of the mattress, as defined by its top edge 42. As seen in FIG. 1, the padded absorbent layer 64 extends in the entire area delimited by the upper edge 27 of the skirt 24. Accordingly, the padded absorbent layer extends substantially between the longitudinal sides 22C, and between the head portion 22A and foot portion 22B of the body 22.

Referring again to FIG. 2, the mattress pad has pocket seams 33, where the top layer 60 is stitched (or otherwise fastened) to the bottom layer 62 adjacent to the pillow 32 to define the pillow pocket 30 between the top layer 60 and bottom layer 62. As illustrated, a skirt seam 66 may extend where the skirt 24 meets the body 22. Note that both the top ply 60 and bottom ply 62 need not extend beyond the skirt seam 66 to define the skirt. Accordingly, in the example illustrated herein, the bottom ply 60 extends coextensively with the mattress pad 20 to define both the skirt 24 and part of the body 22—spanning the body 22 and extending to the lower edge 25 of the skirt 24, where it extends past the lower edge 44 of the mattress 40. The bottom ply 60 ends just beyond the skirt seam 66. Note that in some embodiments, the skirt seam 66 may be figurative—simply delineating where the skirt 24 joins the body 22, and not actually containing a sewn seam. Also, in FIG. 2, the padded absorbent layer 64 is shown extending immediately below the pillow 32. It should be noted, that the pillow 32 can be easily separated, and the pillow pocket 30 more fully defined by adding a fabric layer that extends in the pillow pocket immediately above the padded absorbent layer 64 and then is stitched.

Referring again to FIG. 4, in use, the mattress pad 20 is extended over a bare mattress 40. In particular, the body 22 is laid upon the top 40T of the mattress 40 such that skirt seam 66 corresponds with the upper edge of the mattress, laying the skirt seam substantially along the piping 49 at the upper edge 42, aligning the longitudinal sides 22C of the body with the longitudinal sides 40C of the mattress, and aligning the head portion 22A and the foot portion 22B of the body 22 with the lateral sides 40D of the mattress 40. Then, the skirt 24 is extended downwardly over the longitudinal sides 40C and the lateral sides 40D, such that the lower edge 25 is stretched at the lower corners 26 so that it extends over the piping 49 at the lower edge 44 of the mattress 40, and holds against the bottom 40B of the mattress, to secure the mattress pad 20 onto the mattress 40.

After the mattress pad 20 is secured onto the bare mattress, the bed sheet 50 is extended over the mattress pad. In particular, the sheet body 52 covers the body 22 of the mattress pad 20, and the hem 54 extends over the skirt 24 and secures beneath the mattress 40. Preferably, the bed sheet 50 is a fitted sheet, such that the hem 54 expands and stretches toward the bottom 40B of the mattress 40 and holds tight thereon, trapping the mattress pad 20 between the bed sheet 50 and mattress 40. After the mattress pad 20 is fully covered by the bed sheet 50, an infant can be safely placed thereupon. In particular, the head of the infant may be placed over the pillow pocket 30 and pillow 32 contained therein.

Figure 5A:
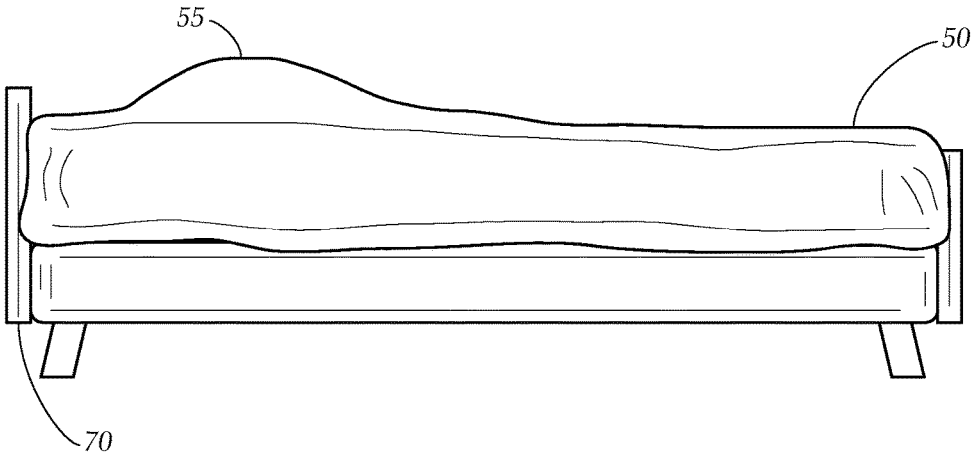
FIG. 5A shows a side view of an example embodiment of a toddler bed covered with the mattress pad according to the present disclosure, and then covered with a standard bed sheet.
Figure 5B:
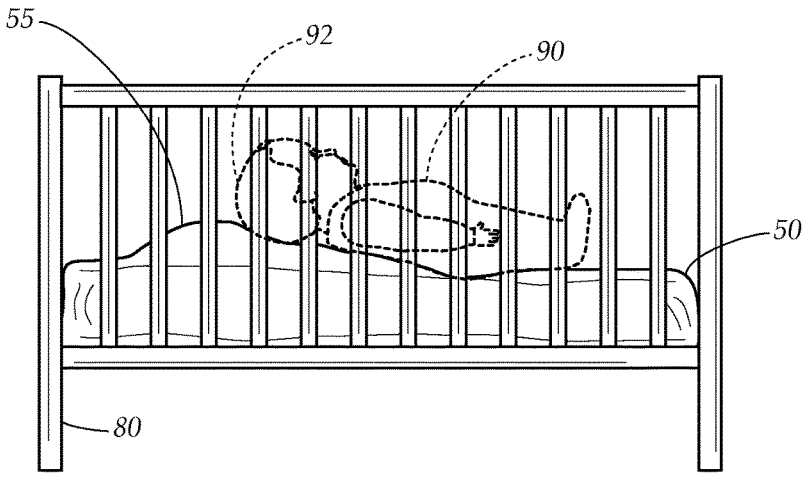
FIG. 5B shows a side view of an example embodiment of a crib covered with the mattress pad according to the present disclosure, and then covered with a standard bed sheet prior to being occupied by an infant.

Referring to FIG. 5A, where a toddler bed 70 is illustrated, and 5B, where a crib 80 is illustrated, the mattress pad is shown in use. In particular, the mattress pad itself can not be seen, as it is fully covered by the bed sheet 50. Between the mattress pad, the mattress, and the bed sheet, the bed sheet 50 is the only part that is exposed or remains visible. While a pillow bump 55 or bulge is clearly present at an area over the pillow, which indicates where the advantages of the pillow may be experienced, the pillow itself is neither visible nor accessible. This keeps the pillow safe from becoming a hazard to the infant. In particular, since the mattress pad, and any pillow access openings are fully covered by the bed sheet 50, the child cannot possibly get to the pillow, nor can it inadvertently be freed from its pillow pocket. Accordingly, once the mattress pad is fully covered with the bed sheet 50, an infant 90 having an infant head 92 can be safely placed upon the mattress. The infant 90 may be placed with the infant head 92 elevated, by placing the infant head at the pillow bump, which indicates that the head is actually being placed over the pillow and pillow pocket located immediately therebeneath.

Note that the mattress pad can be manufactured from and/or include any type of natural and/or man-made textile, cloth and/or bedding material, such as cotton, linen, wool, silk, bamboo fibre, flannel, silver, satin, rayon, polyester, gel, polyurethane, latex, rubber, vinyl, plastic, foam, metal, polypropylene, laminate, wood and/or any blend and/or combination thereof. The fabric components can be of any thread counts when such includes threads. The various layers can be operative to be at least one of washable, waterproof, liquid absorbent, body excretions proof, incontinence repellent, stain repellent, stain releasable, stretchable, fitted, unfitted, anti-microbial, bed bug resistant, padded, non-padded, hypoallergenic and/or any combinations thereof.

While the advantages of the configuration and use described are generally achieved when the mattress pad is used with an infant mattress (or toddler mattress). In theory, the principles described herein can be adapted such that the mattress can be any type of a mattress, such as an inner spring mattress, an air mattress, a water mattress, a foam mattress and/or any combination thereof. The mattress can rest on a box-spring. The mattress can be sized for any type of bed, such as a single bed, a twin bed, a full bed, a double bed, a queen size bed, a king size bed, a cot bed, a bunk bed, a hospital bed, a stretcher, a gurney, a bassinet, a crib and/or any combination thereof. The bed can be for a newborn, an infant, a toddler, a young child, an adult and/or any combination thereof. The bed can be at least partially wheeled, non-wheeled, elevated, non-elevated, side-railed, non-side-railed. A portion of the bed can be elevated and/or moved. The bed can be a specialist bed, such as a standing bed, a turning bed and/or a legacy bed. When the various layers, plys, components are fastened or stitched together such coupling can include stitching, sowing, seaming, fastening, attaching, joining, adhering, magnetically attracting, bolting, stapling, screwing and/or any other combinations thereof. The fastening includes devices and/or means for attaching one portion of material and/or fabric to another portion of material and/or fabric. Such means are typically comprised of complementary portions, which are located relatively opposite one another on complementary portions of material or fabric. Examples of such means include hook and loop fasteners, snap fasteners, button-buttonhole fasteners, interlocking fasteners, zippers, eyes and hooks, snaps, strings, adhesives, surface tensioners, magnetic strips, safety pins, screws, bolts, clamps, hooks, nuts, nails, interlocking male/female connectors, such as fishhook connectors. The absorbent parts of the present disclosure may be washable, waterproof, liquid absorbent, body excretions proof, incontinence repellent, stain repellent, stain releasable, stretchable, fitted, unfitted, anti-microbial, bed bug resistant, padded, breathable, hypoallergenic and/or any combinations thereof.

The description of the present disclosure has been presented for purposes of illustration and description, but is not intended to be exhaustive or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of this application.

What is claimed is:

1. An infant safety mattress pad method, for providing comfort and safety to an infant having an infant head comprising the steps of:

a) providing a bare mattress, the bare mattress having a top, a bottom, lateral sides, and longitudinal sides, the lateral sides and longitudinal sides meet the top of the mattress to form an upper edge and the lateral sides and longitudinal sides meet the bottom of the mattress to form a lower edge;

b) providing a bed sheet, the bed sheet having a sheet body and a hem;

c) providing an infant safety mattress pad, the infant safety mattress pad having a body and a skirt, the body having a head portion, a foot portion, and sides, the body further having a top layer, a bottom layer, and a padded absorbent layer positioned between the top layer and the bottom layer, and the body further having a pillow pocket positioned near the head portion, the pillow pocket holding a pillow between the top layer and the padded absorbent layer, the mattress pad further including pocket seams directly securing the top layer, the padded absorbent layer, and the bottom layer to each other, the pocket seams extending transversely across the mattress and being located on opposing sides of the pillow pocket, the skirt having a skirt lower edge including elastic lower corners, the mattress pad body having a skirt seam at the head portion proximate to the mattress upper edge between the edge and the nearest pocket seam, the skirt seam being spaced from the padded absorbent layer and directly securing the top layer of the mattress pad body to the skirt;

d) covering the bare mattress with the infant safety mattress pad by placing the bottom layer in contact with the top of the bare mattress and aligning the skirt seam with the upper edge of the mattress;

e) extending the skirt lower edge below the lower edge of the mattress to contact the mattress bottom and stretching the skirt lower edge at the lower corners to grip the lower edge of the mattress;

f) covering the top layer of the infant safety mattress pad with the bed sheet body; and g) laying the infant upon the bed sheet body with the infant head over the pillow pocket.

2. An infant safety mattress pad method, comprising the steps of:

a) providing a bare mattress, the bare mattress having a top, a bottom, lateral sides, and longitudinal sides, the lateral and longitudinal sides meet the top of the mattress to form an upper edge and the lateral sides and longitudinal sides meet the bottom of the mattress to form a lower edge;

b) providing a bed sheet, the bed sheet having a sheet body and a hem;

c) providing an infant safety mattress pad, the infant safety mattress pad having a body and a skirt, the body having a head portion, a foot portion, and sides, the body further having a top layer, a bottom layer, and a padded absorbent layer positioned between the top layer and the bottom layer, and the body further having a pillow pocket positioned near the head portion, the pillow pocket holding a pillow between the top layer and the padded absorbent layer, the mattress pad further including pocket seams directly securing the top layer, the padded absorbent layer, and the bottom layer to each other, the pocket seams extending transversely across the mattress and being located on opposing sides of the pillow pocket, the skirt having a skirt lower edge including elastic lower corners, the mattress pad body having a skirt seam at the head portion proximate to the mattress upper edge between the edge and the nearest pocket seam, the skirt seam being spaced from the padded absorbent layer and directly securing the top layer of the mattress pad body to the skirt;

d) covering the bare mattress with the infant safety mattress pad by placing the bottom layer in contact with the top of the bare mattress and aligning the skirt seam with the upper edge of the mattress; and e) extending the skirt lower edge below the lower edge of the mattress to contact the mattress bottom and stretching the skirt lower edge at the lower corners to grip the lower edge of the mattress; and f) covering the top layer of the infant safety mattress pad with the bed sheet body, and folding the hem around the lower edge of the mattress to contact the mattress bottom.

* * * * *